US005096275A

United States Patent [19]

Pappas

[11] Patent Number: 5,096,275

[45] **Date of Patent: * Mar. 17, 1992**

[54] ELECTRIC STORAGE BOX

[76] Inventor: Diane M. Pappas, 3600 NE. 170st, #D308, N. Miami Beach, Fla. 33160

[ * ] Notice: The portion of the term of this patent subsequent to Dec. 17, 2007 has been disclaimed.

[21] Appl. No.: 181,055

[22] Filed: Apr. 13, 1988

[51] Int. Cl.[5] ..... A47B 88/00

[52] U.S. Cl. ..... 312/312

[58] Field of Search ..... 312/312, 245, 216; 211/13

[56] References Cited

U.S. PATENT DOCUMENTS

| | | | |
|---|---|---|---|
| 630,505 | 8/1899 | Hicks | 312/216 X |
| 806,965 | 12/1905 | Field | 312/312 X |
| 1,668,781 | 5/1928 | Pierce | 312/312 X |
| 2,463,506 | 3/1949 | Ball | 312/312 X |
| 2,861,857 | 11/1958 | Lee et al. | 312/312 X |
| 3,028,209 | 4/1962 | Hinkel et al. | 312/312 X |
| 4,209,212 | 6/1980 | McGoldrick | 312/245 |
| 4,329,928 | 5/1982 | Shaw | 312/312 X |
| 4,500,148 | 2/1985 | King | 312/312 |
| 4,776,650 | 10/1988 | Ferenzi | 312/245 |

*Primary Examiner*—Joseph Falk
*Attorney, Agent, or Firm*—Diane Pappas

[57] ABSTRACT

A cabinet used for storing items comprising of a housing having front, rear, top, bottom and a pair of side walls. It has a plurality of box-like members comprising of a top, bottom, rear, and a pair of side walls contained within housing. The top wall of housing has a plurality of openings to which box-like members emerge upwardly from housing to an open position by a power operated or manual means of opening upwardly and closing downwardly. The box-like members have hooks, brackets, ring slots and or shelving means attached to rear walls and/or side walls of box-like members for storage and organizational purposes. This cabinet has optional features as; locking means, lighting means and on any size scale can be used for storing items such as tools, ties, video or CD cassette storage, clothing when fitted with a rod for hanging garments. This cabinet can be made out of wood, plastic, or the like and with many selected colors to match any decor.

1 Claim, 7 Drawing Sheets

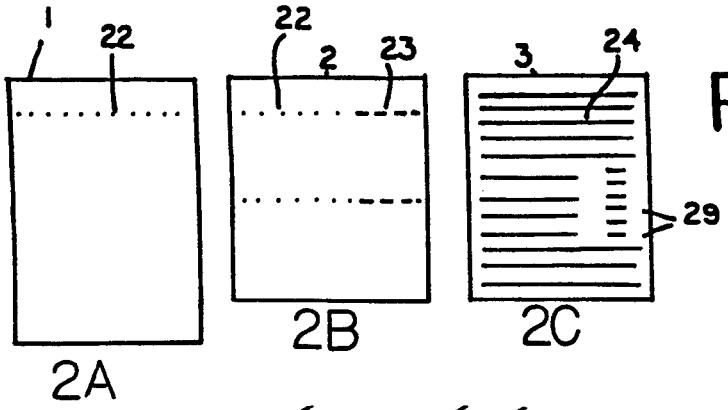
FIG. 2
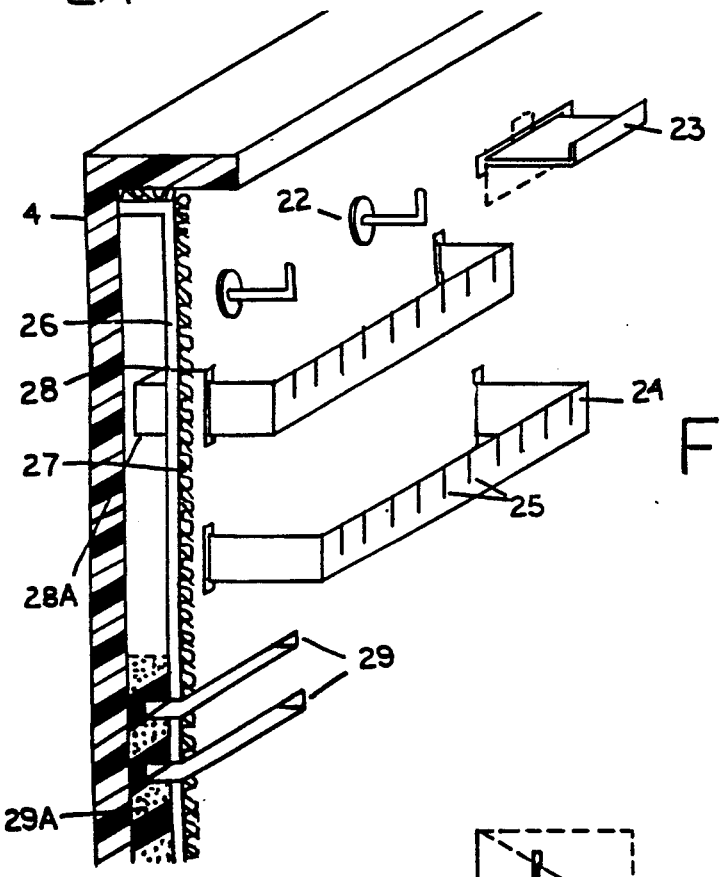
FIG. 3
FIG. 3A
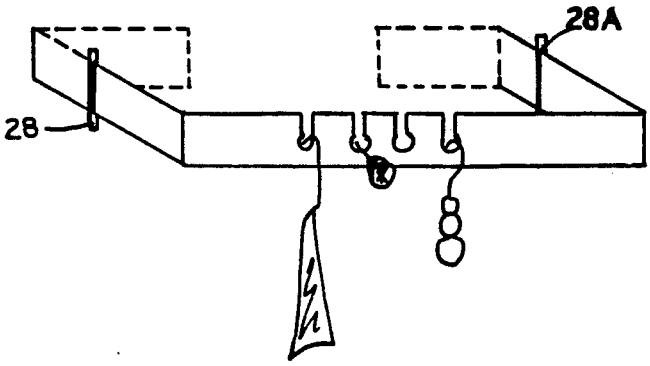

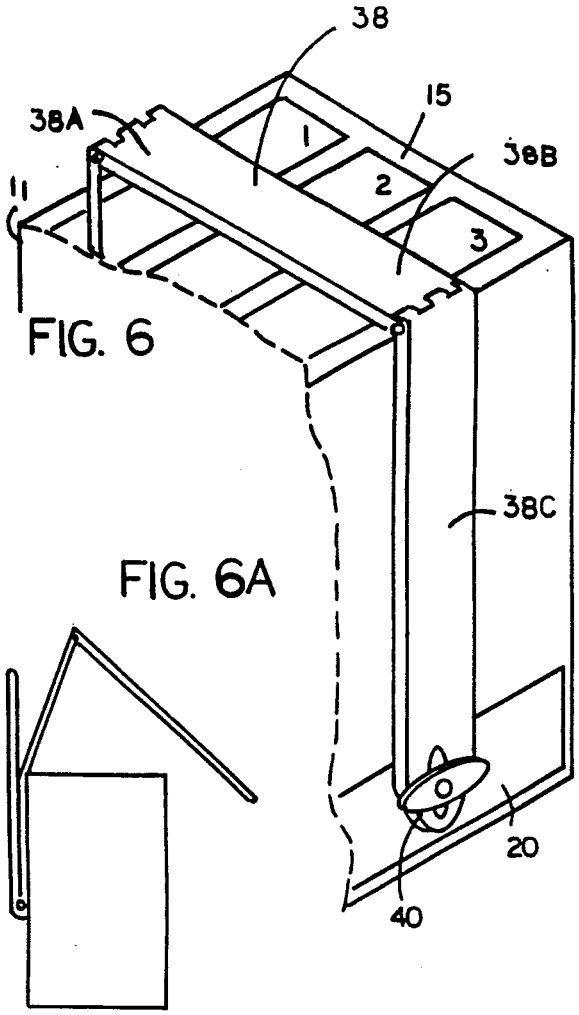
FIG. 6
FIG. 6A
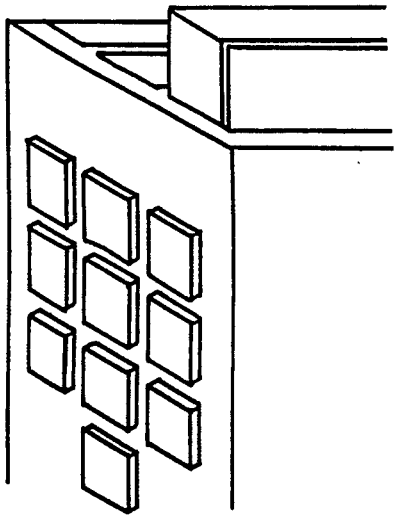
FIG. 7
FIG. 8A
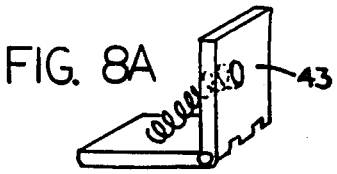
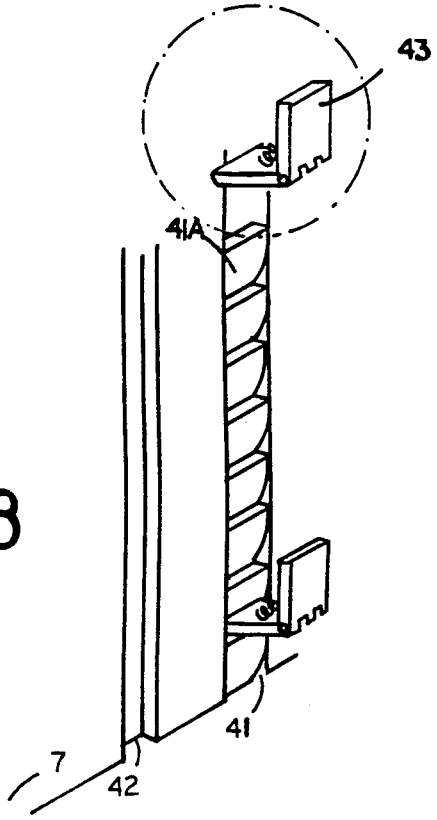
FIG. 8

FIG. 9A 9B 9C 9D
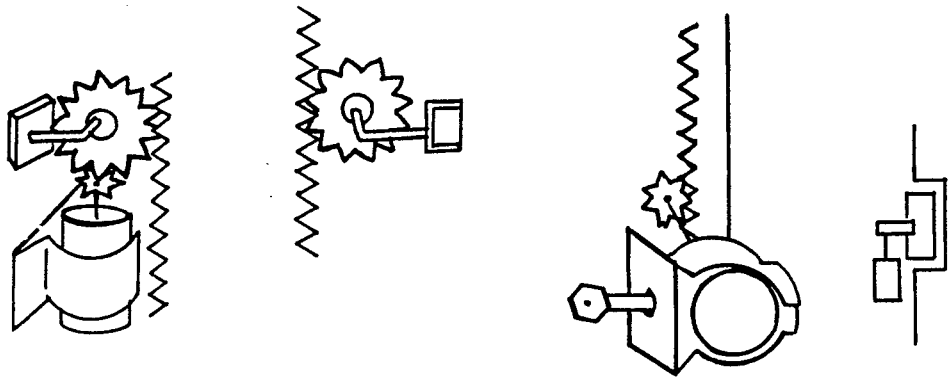
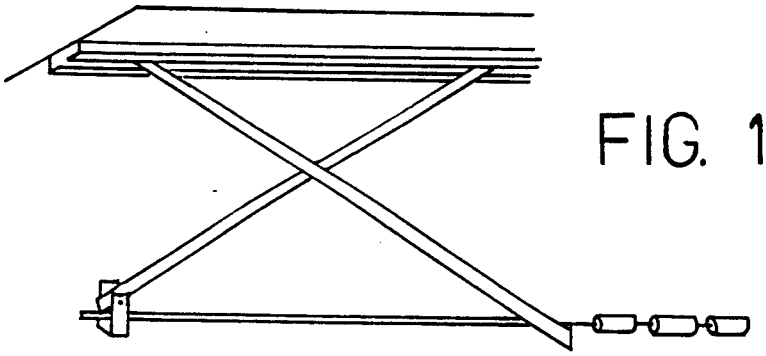
FIG. 10
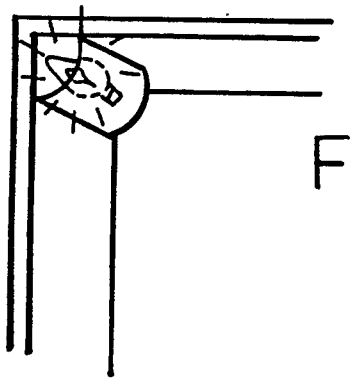
FIG. 11

FIG. 12
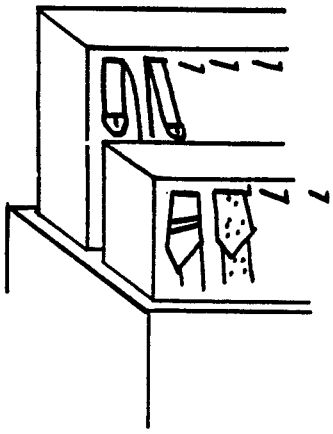
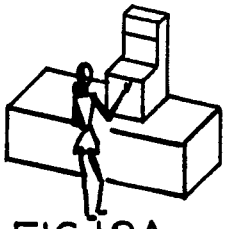
FIG. 12A
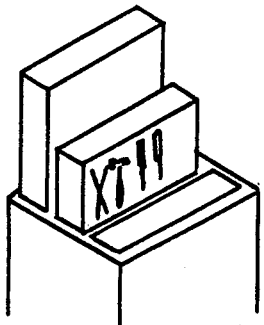
FIG 13A
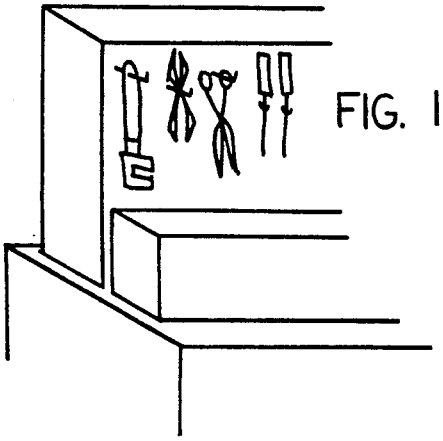
FIG. 13
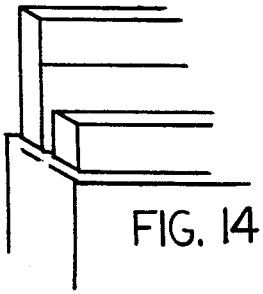
FIG. 14
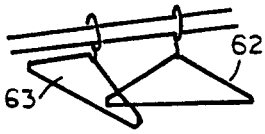
15C
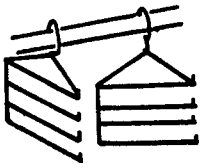
15B
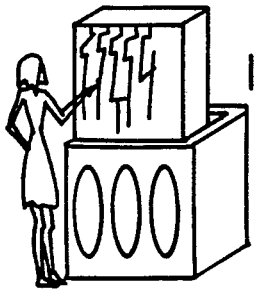
15A
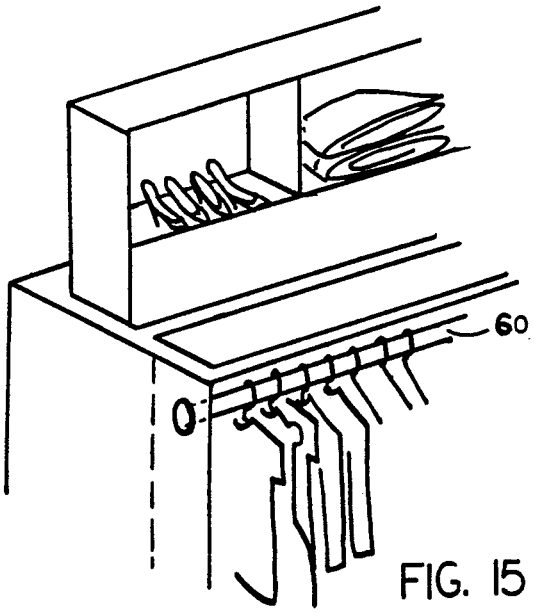
FIG. 15

ELECTRIC STORAGE BOX

This invention relates to a storage box and a bookcase and particularly to a storage box containing cases which elevate upwardly out of said box to house objects to be hung or placed in said cases, and closes in a downward motion into said box by a motor driven means.

Prior Art As Compared To My Invention

U.S. Pat. No. 4,209,212 is convenient for hanging hook earrings only, for two piece post earrings it is not convenient to lift up flap, separate post parts, insert in flap and put on backing, is a chore to put earrings on and off. Also, flap is made of soft material that with much use this said flap will be full of holes, and be of no use. The Vertical storage box (now refered to VSB) corrects this problem with a one piece bracket that holds hook and post earrings without taking earring pieces appart, just sliding whole earrings into slit provided.

U.S. Pat. No. 4,776,650 is similar but the poor way of affixing the straight braket on to the cabinet door can cause the bracket to come off cabinet when removing an earring. Also trying to remove an earring would disrupt the above row of earrings and cause them to fall off too. In addition costume jewelry should not be exposed to the moisture in a bathroom.

Again the VSB corrects this problem with the one piece bracket affixed to the behind backing preventing bracket from falling off. Secondly, to avoid disrupting other earrings above my bracket pulls out for easy removal of earrings and pushes back in when not in use.

U.S. Pat. No. 2,861,857 has little spacing between shelving with a deep storage space creating inconvenience in having to reach in back of cabinet for retrieving items also, said table could only be used for ornamental use and not as a working surface as there is no room for a chair and leg space.

U.S. Pat. No. 3,028,209 must be specially fitted and installed by professionals. Whereas VSB can be purchased and placed anywhere with no installation needed. This invention stated above has it opening in a downward position requiring unit to be anchored to wall or ceiling, whereas the VSB sits on a countertop or positioned on the floor. This invention as stated above also has deep and narrow shelf spaces.

SUMMARY

The vertical storage box has many advantages as the cases are narrow like a bookcase allow easy sight of items stored and easy removal of said items, provides organization, separateness and tanglefreedom as comparing with throwing into a box. Storage box has hooks for hanging objects or shelving for placing items on. The vertical storage box can be moved to any countertop in the house or office, or placed on the floor as furniture as invention on a larger scale. Cases are lifted up manually or electrically with a motor driver means lifting cases up and down with a flip of a switch.

FIG. 2 is the layout of hooking means of each case.

FIG. 3 is a view in detail of the portion indicated by section lines 1—1 in FIG. 1.

FIG. 3A is an exploded view of bracket of FIG. 3.

FIG. 6 showing lock and latch device.

FIG. 7 showing combination locking means.

FIG. 8 is an exploded perspective view illustrating manual opening and closing mechanism indicated by section lines 1—1 in FIG. 8A.

FIG. 8B illustrating top cross-section view indicated by section lines 2—2 in FIG. 8A.

FIGS. 9A and 9B illustrate alternate motor-gear apparatus.

FIG. 10 illustrates scizzor-jack apparatus.

FIG. 11 illustrates optional lighting means.

FIG. 12 illustrates tie and belt storage box.

FIG. 12A illustrates size of VSB in relation of human figure.

FIG. 13 showing tool storage box.

FIG. 14 showing bookcase, video case, CD case, etc.

FIG. 15 showing VSB on larger scale as a dresser holding shoes, linen, clothing on rod.

FIG. 15A showing size in relation to human figure.

FIGS. 15B and 15C is an exploded view of swivel hanger as indicated in FIG. 15 (63).

Figure 1:
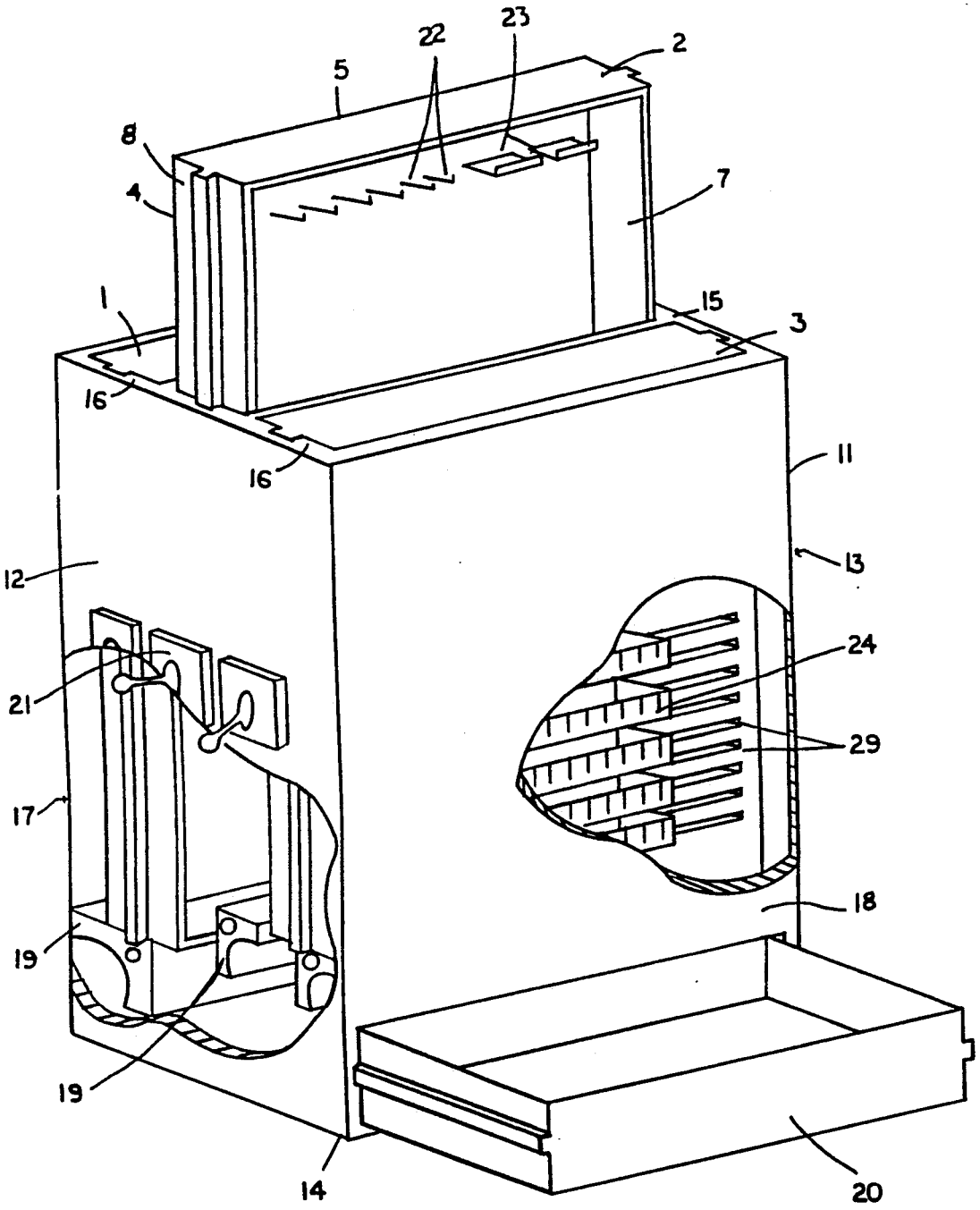
FIG. 1 is a perspective view of the vertical storage box illustration one of the cases partially raised, and having front 11 section of box removed showing layout of cases.

Refering to the drawings by numerals, FIG. 1 shows three cases (1) (2) (3) standing upright, having a back wall (4), top wall (5), and side walls (7) (8) having a tongue like piece (9) (10) on the center of each side wall (7) (8) extending down the length of each side wall (7) (8). Box-like enclosure (11) having 2 side walls (12) (13) enclosing cases, a bottom wall (14) and a top fitted piece (15) with sections cut out to fit around cases (1) (2) (3) for spacing, and grooves cut out (16) cut horizontally down length of inner wall, corresponding to each tongue (9) (10) to guide said case. The box-like enclosure (11) has case supporting brackets (19) to support bottom of said cases (1) (2) (3) to serve as a stopper. The box-like enclosure has a back wall (17) and a front wall (18) having a section cut out for bottom horizontal drawer (20) to emerge manually out of said front wall (18). Box (11) has switches (21) inserted on one side of box (12) to be discussed further on.

FIG. 2: Case (1) has hooks (22) to hold necklaces: Case (2) has hooks (32) and wider hooks (23) for watches and bracelets. Case (3) has a special one-piece brackets (24) and ring slots (29).

Figure 4:
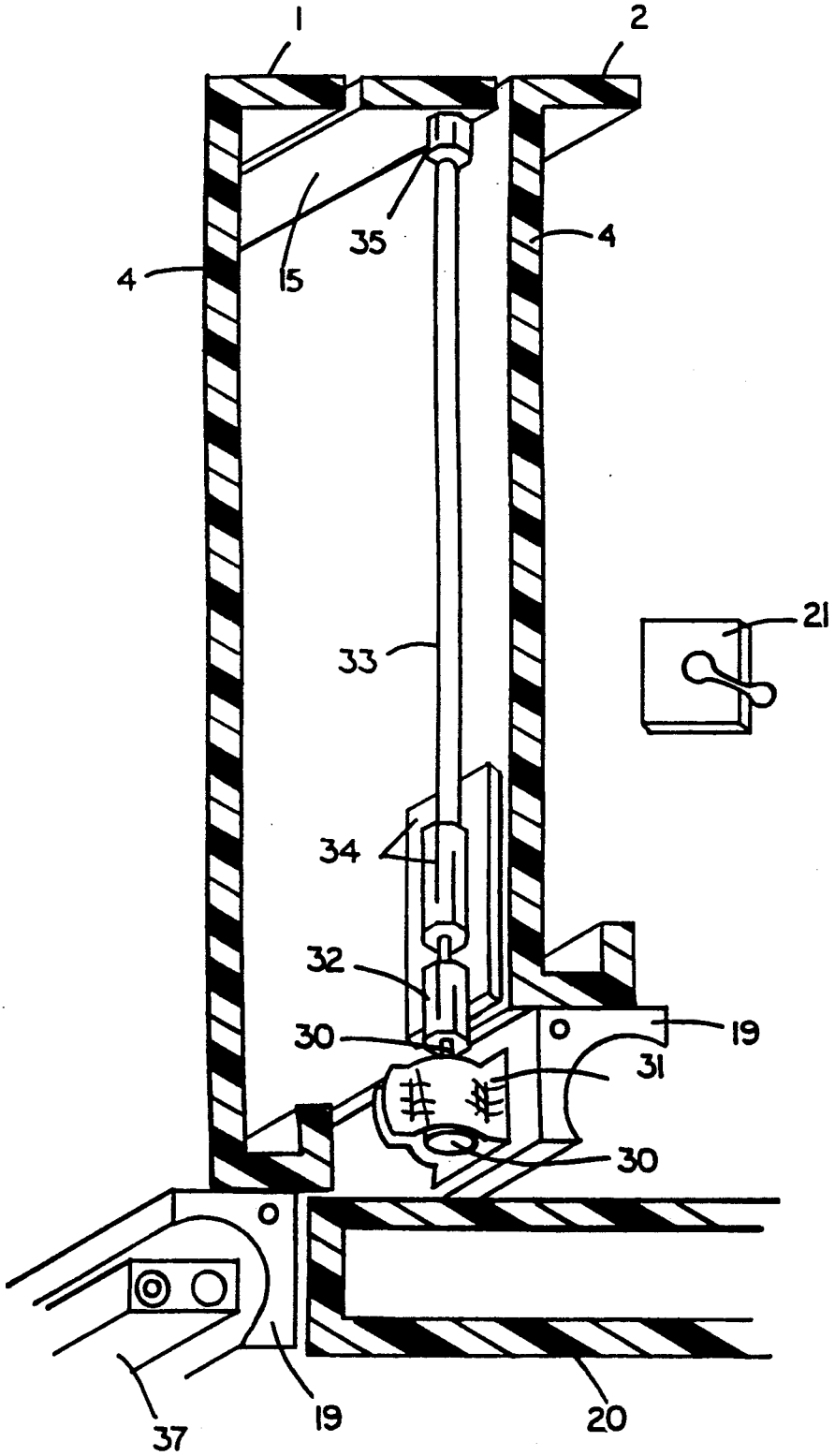
FIG. 4 is a view in detail of the portion indicated by section lines 2—2 in FIG. 1.

FIG. 3: Special brackets (24) have slits (25) cut out, properly spaced apart to allow for wider earrings. Case (3) has an inner wall (26) made of a stiff material (26) and an overlay of a velvet-like material (27) for decorative purposes. Inner wall (26) has slits cut through it (28) for bracket insertion. Bracket (24) has ends bent over (28A) in the back, behind inner wall (26). Ring slots (29) are cut horizontally through inner wall (26) one slot under the other, properly spaced apart, to allow for bigger rings. There is a foam-rubber like vertical strip (29A) affixed between inner wall (4) placed behind ring-slots (29) having slots cut out corresponding with slots of ring-slots (29). FIG. 4 cases (1) (2) (3) elevate up and down by way of flipping switch (21) connected to a motor (30) which is attached to supporting brackets (19) under each case (1) (2) (3) by a clamp (31). A coupler (32) is welded on to the motor's shaft (30), a threaded rod (33) is welded inside the coupler (32). Another coupler welded to a metal strip (34) now referred to as a case coupler (34) is affixed to the center, bottom portion of case (1) (2). Case coupler (34) is inserted on threaded rod (33). When switch (21) is activated, it turns motor (30) which turns coupler (32) and threaded rod (33). Case coupler (34) moves up the threaded rod (33) moving case (1) (2) up and stops at the top by way of a stopper (35) affixed to the inside top of box (15). Power source (37) is connected to switch (21). Each case (1) (2) (3) has its own motor mechanism (36) case (1) has motor clamp (30) (31) attached to inside of box's back wall (17). Case (2) and case (3) are each attached to center of support bracket (19) located under each case (2) (3).

FIG. 6. A locking means is presented in a double-hinged, 3 section lactch (38), the back section of latch (38A) is attached to center-upper-back of box (11). The middle section of latch (38B) extends over the top of box (15) covering cases (1) (2) and (3), then latch extends (38C) down to bottom of box (15) cover center of bottom horizontal drawer (20). A vertical oval (39). Bottom drawer has a vertical lock (40) affixed in the center. Latch nole fits over lock (40), when key is inserted it turns top section of lock (40A) to a horizontal position therefore locking latch (38).

This locking means is just one possible way of locking said box, FIG. 7. Another locking means would be a combination locking means.

While the above discription contains many specifications, these should not be construed as limitations to the scope of the invention but rather as an exemplification of one preferred embodiment thereof many other vatiations are possible—for example:

FIG. 8. Manual opening and closing.

Case sides (7) (8) have tongue and groove (41A) and another groove cut out (42) next to first groove (41A). Spring activated stopper (43) is affixed to the bottom of the side panel (7) of cases (1) (2) (3) get to fully open position. Stopper (43) secures case (1) (2) or (3) in up position. To lower case, case is pushed down, closing the stopper (43) allowing case (1) (2) or (3) to move downward into closed position, affixed to side interior of box (12) has motor (51) and gear (52), which moves toothed track (53) affixed to side of case (7) which moves case (1) (2) or (3) up and down. FIG. 10. Possible scuzzor-jack mechanism. FIG. 11 optional lighting means FIG. 12 vertical storage box on a larger scale holding belts and ties with brackets (54) made to hold each item.

FIG. 13 VSB as a tool case to hang tools up, or sewing case, FIG. 14 shows VSB holding books, CD's, videos, cassettes, etc.

I claim as my invention:

1. A cabinet used for storing items comprising:

a housing having front, rear, top bottm and a pair of side walls;

said top wall having a plurality of openings said side walls each having guide means mounted therein which extend from each opening in the top downwardly into the interior of the cabinet;

a plurality of box-like members having top, bottom, rear, and a pair of side walls;

slide members mounted on each of sidewalls of the box-like members for slidably engaging said guide means;

said rear wall having forwardly projecting narrow hooks for supporting necklaces or other objects to be hung, forwardly projecting wide hooks for supporting items, movable bracket-like fixtures with vertical slits cut out from top to center of said bracket-like fixtures which slides outwardly for removal of earrings and inwardly sliding back to original position for storage, ring slots cut out horizontally in the rear wall and shelving means to place items on and said in box-like members for additional storage:

means for driving each of said box-like members through respective openings upwardly and downwardly.

* * * * *

UNITED STATES PATENT AND TRADEMARK OFFICE

CERTIFICATE OF CORRECTION

PATENT NO. : 5,096,275

DATED : March 17, 1992

INVENTOR(S) : Diane Pappas

It is certified that error appears in the above-identified patent and that said Letters Patent is hereby corrected as shown below:

Col. 1, line 62, "illustration" should read --illustrating--

Col. 1, line 65, deleted "Fig. 2 is the layout of hooking means" and insert --Fig. 2, is the possible layout of hooking means--.

Col. 1, delete lines 66, 67 and insert --Fig. 3, is a view in detail of various hooking means--.

Col 2, delete lines 1 and 2, and insert --Fig. 4 is a view in detail of possible drawer and motor means--

Col. 2, line 4, after "drawer layout delete (Counter box removed). and insert --(Outer box removed)--

Figure 5:
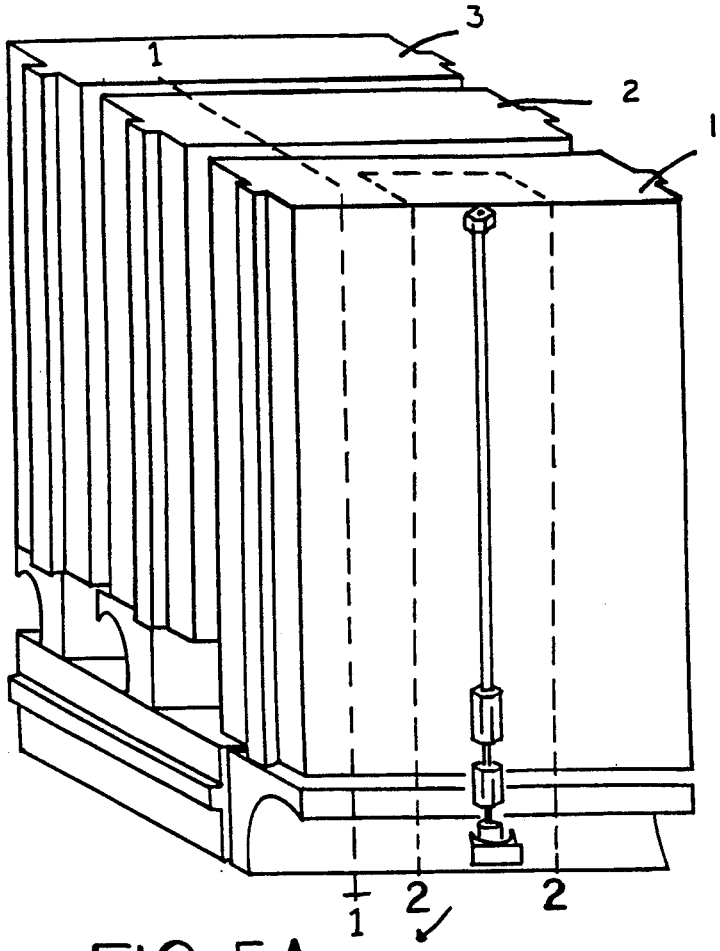
FIG. 5 is a rear perspective view of the case and drawer layout. (Counter box removed).
Figure 5A:
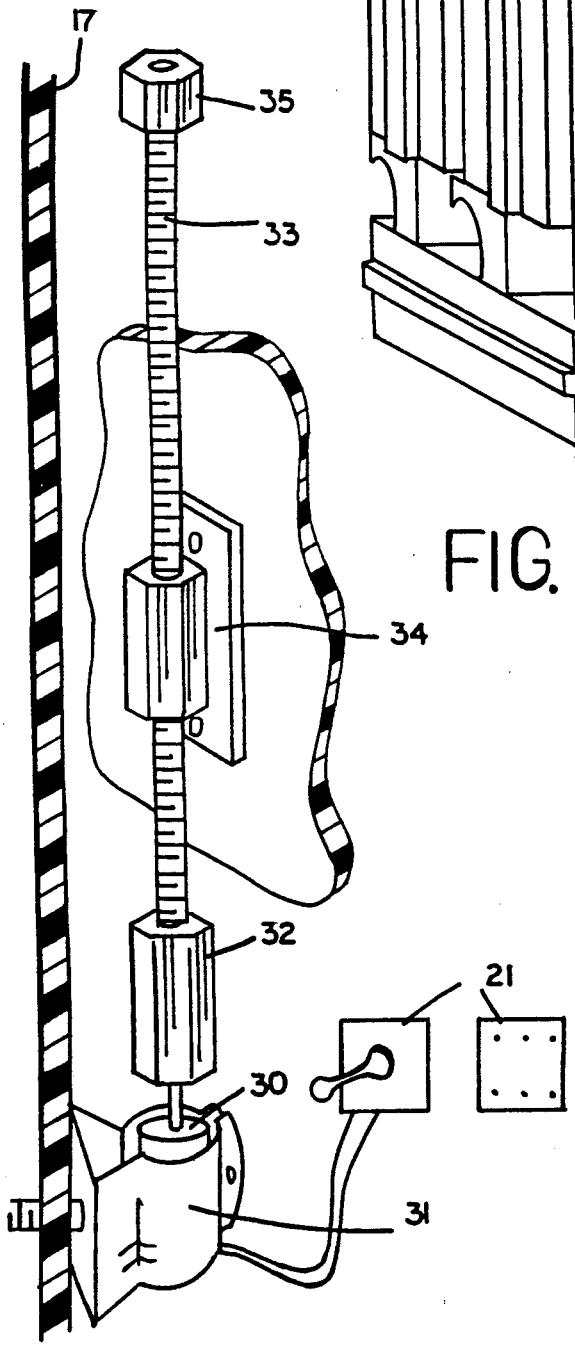

Col. 2, line 4, insert --Fig. 5A is an enlarged view of motor-guide apparatus--

Col. 2, line 7, after "Fig. 8 is an exploded perspective view illustrating manual opening and closing mechanism" insert --Fig. 8A is an enlarged view of the portion indicated in Fig. 8--

Col. 2, line 8 delete "indicated by section lines 1-1 in Fig. 8A"

Col. 2, delete lines 10 and 11.

Col. 2, line 12 delete "Figs 9A and 9B illustrate" and insert --Figs. 9A-9D illustrate--

UNITED STATES PATENT AND TRADEMARK OFFICE

CERTIFICATE OF CORRECTION

PATENT NO. : 5,096,275

DATED : March 17, 1992

INVENTOR(S) : Diane Pappas

It is certified that error appears in the above-identified patent and that said Letters Patent is hereby corrected as shown below:

Column 2, line 14, "scizzor" should read --scissor--

Col. 2, line 25, delete --(63)--

Col. 2, delete line 32 and insert -- a bottom wall (14) and optional top wall (15)--

Col. 4, line 4, "scuzzor-jack" should read --scissor-jack--

Signed and Sealed this

Fifth Day of October, 1993

Bruce Lehman

*Attest:*

BRUCE LEHMAN

*Attesting Officer*

*Commissioner of Patents and Trademarks*